US005501359A

United States Patent [19]

Chauvin et al.

[11] Patent Number: 5,501,359

[45] Date of Patent: Mar. 26, 1996

[54] PREFABRICATED STRUCTURE FOR FORMING FLUID-TIGHT AND THERMO-INSULATED WALLS FOR VERY LOW TEMPERATURE FLUID CONFINEMENT CONTAINER

[75] Inventors: Jean-Michel Chauvin, Plaisir; Jean M. Claude, Rambouillet, both of France

[73] Assignee: Societe Nouvelle Technigaz, Montigny-le-Bretonneux, France

[21] Appl. No.: 185,820

[22] PCT Filed: May 19, 1993

[86] PCT No.: PCT/FR93/00492

§ 371 Date: Mar. 10, 1994

§ 102(e) Date: Mar. 10, 1994

[87] PCT Pub. No.: WO93/23699

PCT Pub. Date: Nov. 25, 1993

[30] Foreign Application Priority Data

May 20, 1992 [FR] France ..... 92 06136

[51] Int. Cl.[6] ..... B63B 3/00

[52] U.S. Cl. ..... 220/452; 220/468; 220/901; 312/406

[58] Field of Search ..... 220/420, 452, 220/901, 435, 468; 312/400, 406, 406.1

[56] References Cited

U.S. PATENT DOCUMENTS

| | | | |
|---|---|---|---|
| 3,341,051 | 12/1964 | Forman et al. | 220/901 |
| 3,367,492 | 2/1968 | Pratt et al. | 220/901 |
| 4,066,184 | 1/1978 | Cuthbert et al. | 220/901 |
| 4,116,150 | 9/1978 | McCown | 220/901 |
| 4,117,947 | 10/1978 | Androulakis | 220/435 |
| 4,128,069 | 12/1978 | Kotcharian | 220/901 |
| 4,199,909 | 4/1980 | Kotcharian | 220/901 |
| 4,335,831 | 6/1982 | Swaney | 220/901 |
| 4,747,513 | 5/1988 | Betille et al. | 220/901 |

FOREIGN PATENT DOCUMENTS

| | | |
|---|---|---|
| 2386771 | 11/1978 | France . |
| 2599468 | 12/1987 | France . |

*Primary Examiner*—David Scherbel
*Assistant Examiner*—Tony G. Soohoo
*Attorney, Agent, or Firm*—Steinberg, Raskin & Davidson

[57] ABSTRACT

The present invention relates to a prefabricated structure providing fluid-tight and thermo-insulated walls for a heat-insulated confinement container such as a fluid-tight reservoir for storage and/or transport of a very low temperature fluid. Said structure (1) comprised of an internal flexible and fluid-tight barrier (2), a heat insulation system (4) and an external wall (3) forming support for the structure (1), is characterized in that distribution walls (53) integral with the external wall (3) are fixed to the latter particularly by means of screws or the like (35) arranged facing holes (435) drilled in an external insulation layer (43) at a distance from the joints (63) between plates (43*a*) forming said layer, a fluid-tight connector (80) being sealingly arranged in each of the holes (435) and joints (63). The invention applies to the construction of structures forming fluid-tight reservoirs, for example for tankers which transport cryogenic liquids such as methane tankers.

11 Claims, 3 Drawing Sheets

PREFABRICATED STRUCTURE FOR FORMING FLUID-TIGHT AND THERMO-INSULATED WALLS FOR VERY LOW TEMPERATURE FLUID CONFINEMENT CONTAINER

BACKGROUND OF THE INVENTION

The present invention relates to a prefabricated structure permitting to provide fluid-tight and thermally insulating walls for a lagged confinement structure such as a fluid-tight tank for the storage and/or the transport of a fluid at very low temperature such for example as a liquefied gas or a cryogenic liquid.

One has already described in particular in the document FR-A-2,599,468 in the name of the applicant, a structure constituted by prefabricated elements assembled so as to obtain a hermetic lagged enclosure which may for example contain liquefied methane. This structure of the prior art may be mounted in the hold or double-hold of a merchant ship. The self-supporting rigid bulkheads form an external support for the other elements of the structure. An internal or primary fluid-tight barrier which defines a substantially deformable hermetic vessel provided for containing the fluid is assembled from elements generally of metal inside of the space defined by the external partitions of the support. A thermal insulation system is interposed between the external partitions and the primary barrier. This insulation system comprises at least two layers of insulating and fluid-tight material such as a plastic foam with closed cells formed through juxtaposition of prefabricated plates. Both insulation layers are held like a sandwich by two panels for example of plywood for the distribution of the forces inside of the structure. One panel made fast to the external partition is stuck to a so-called "external" insulation layer whereas the other panel, which is made fast to the internal barrier, is adhered to another so-called "internal" layer. To maintain the fluid-tightness of the structure in case of cracking of the primary barrier, plugs provided in the same type of material as the insulation plates are disposed within the joints between the juxtaposed plates of the external layer and then are respectively covered with a strip hermetically stuck to the external layer and generally comprises a central fluid-tight aluminum foil as well as two layers of glass fibre fabric.

However in the known structures at the level of the joints, only the cover strip ensures the fluid-tightness between the internal and external insulation layers. In fact in case of a leakage through the primary barrier, all the fluid-tightness is based upon this strip, thereby risking to generate a cooling if one of these cover strips ceases to be hermetic.

Moreover since in the known structures the panels for the distribution of the forces are constituted by elements assembled with the assistance of screws or the like extending into the joints of the external insulation layer, one concentrates upon the joints the risks of loss of fluid-tightness.

OBJECTS AND SUMMARY OF THE INVENTION

Therefore the present invention has for its object to cope with the hereabove inconveniences by proposing a simple and economic structure in which the insulation layers are continuous and therefore perfectly fluid-tight.

For that purpose the invention has for its subject a prefabricated structure for the formation of fluid-tight and thermally insulating walls for the provision of lagged enclosures for the confinement of a fluid at a very low temperature such as a liquefied gas. The structure comprises a substantially flexible internal or primary fluid-tight barrier to which is made fast a so-called internal distribution panel, an external rigid partition forming a support for the structure. The structure further comprises another so-called external panel as well as two intermediate thermal insulation layers held like a sandwich between the so-called internal and external distribution panels, respectively. Each layer, which is provided by the juxtaposition of insulating plates of fluid-tight material as for example a plastic foam with closed cells, defines the joints between the plates disposed respectively in front of one plate of the other layer. Each joint of the external insulation layer is covered with a strip stuck between both insulation layers. The external distribution panels are fastened to the external partition in particular by screws or the like disposed in front of holes formed in the external layer at a distance from the joints. A fluid-tight connector of insulating material fills up and hermetically adheres to each one of these holes and joints in order that the external insulation layer be continuous and fluid-tight over the whole surface formed by the structure.

One already understands that owing to the continuous external insulation layer the fluid-tightness of the structure peculiar to the invention may be checked very easily and quickly with respect to the structures of the prior art, for example by the measurement of pressure differentials.

According to another characteristic of the invention, the cover strip is constituted by a continuous reinforcing sheet of glass fiber or the like which extends over a surface substantially greater than that of the plate juxtaposed to the internal insulation layer in front of the junction to be covered and preferably over the whole surface of the corresponding wall formed by the structure.

According to still another characteristic, one at least of the aforesaid connectors is an inserted part of a shape corresponding to that of the joint or of the hole to be filled up, of which at least the external peripheral surface is coated with an adhesive preferably foaming material.

One should further specify here that at least one of the aforesaid connectors is constituted by two elements substantially symmetrical with respect to a middle plane of assembly and the confronting internal assembly surfaces of which are coated with adhesive material.

The invention also characterizes itself in that at least one of the aforesaid connectors is formed in situ through injection under pressure of the aforesaid fluid-tight plastic insulation material into the hole or the joint to be filled up.

Furthermore the material forming the aforesaid connectors is injected through the medium of a tool bearing upon the surface of the external insulation layer opposite to the external partition and fastened to the latter in front of the opening of the hole or of the joint to be filled up.

Moreover the stresses generated inside of or between the juxtaposed plates of the external insulation layer by the aforesaid connectors in the final position have a negligible value.

According to another characteristic, a pad of fluid-tight material onto which hermetically adheres the aforesaid connector of a joint is interposed between the external reinforcing panel and partition.

One should also note here that a yielding fitting is interposed between the plates of insulating material which constitute the internal insulation layer and adheres to the latter.

BRIEF DESCRIPTION OF THE DRAWINGS

But further characteristics and advantages of the invention will appear better from the detailed description of embodiments given by way of example only which follows and refers to the attached drawings.

DETAILED DESCRIPTION OF THE PREFERRED EMBODIMENT

Figure 1:
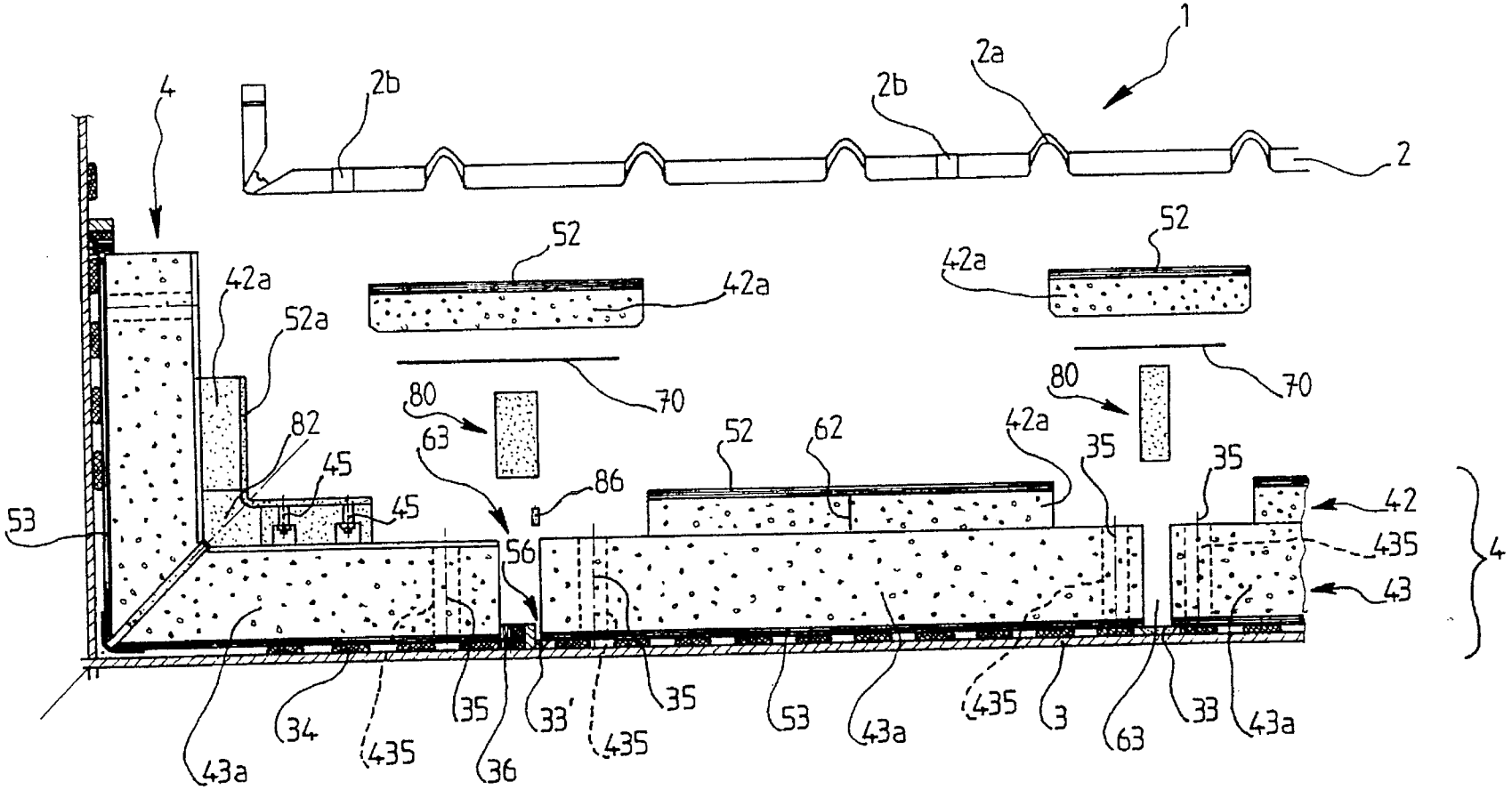
FIG. 1 is an exploded view in cross-section of a prefabricated structure according to the invention.

Referring in particular to FIG. 1 one sees a prefabricated structure 1 which permits to form fluid-tight and thermally insulating wall for the provision of a confinement enclosure or tank for example for storing and/or conveying a fluid at a very low temperature. Here and this by way of example only the structure 1 is a tank constituted by an assembly of fluid-tight and lagged walls in which a cryogenic liquid such as a very cold liquefied gas such in particular as methane may be stored.

The structure 1 comprises a fluid-tight internal envelope adapted to contain the fluid to be stored, which consists of an assembly of prefabricated elements forming together for each wall of the structure 1 a fluid-tight internal or primary barrier 2. On FIG. 1 the primary barrier 2 is formed of fine metal elements such as a stainless steel or aluminum sheet. The reference numeral 2*a* designates ribs projecting in parallel relation to the connectors 2*b* between the different elements of the barrier 2 which allow the envelope constituted by this barrier to be substantially flexible in order that it may deform itself under the effect of the in particular thermal forces generated by the fluid stored in the latter. A rigid external partition 3 of the structure 1 performs the function of a support for the latter. According to the illustrated example this partition is a self-supporting metal sheet of the hold or of the double-hold of a merchant ship such as a methane conveying tank ship. Of course other types of rigid partitions the mechanical properties of which are suitable such in particular as a concrete wall in a building on the mainland could be used as an external partition for supporting the structure 1.

Furthermore a thermal insulation system generally designated at 4 is provided between the primary barrier and the external partition 3. The insulation or lagging system 4 of the structure 1 in particular comprises an internal insulation layer 42 to which is connected the primary barrier as well as an external insulation layer 43 made fast to the external support partition 3.

The external and internal layers 42, 43 are made from a fluid-tight thermal insulation material. Advantageously one will use a plastic or synthetic foam with closed cells. In particular, a polyurethane-based or polyvinyl chloride-based foam with closed cells could be perfectly appropriate for the making of these insulation layers 42, 43.

On FIG. 1 one sees that both insulation layers 42, 43 are held in sandwich-like fashion or clamped between two panels 52 and 53 for the distribution of the forces. These respectively internal and external panels 52, 53 are for example made from assembled elements of plywood or laminated wood. The internal and external panels 52 and 53 permit to merely uniformly distribute within the structure and in particular the insulation system 4 the stresses for example connected to the deformations of the external partition 3 and of the envelope defined by the internal barrier 2. To do this, the panel 52 is bearing and preferably stuck upon the top surface (i.e. the one closest to the barrier 2) of the insulation layer 42 whereas the external panel 53 is bearing and preferably stuck onto the bottom surface (namely in front of the partition 3) of the insulation layer 43.

Since the structure 1 is prefabricated each insulation layer 42, 43 is constituted by the juxtaposition of insulating plates of fluid-tight material designated at 42*a* or 43*a*, respectively, and the shape of which generally is prismatic rectangular. It is obvious that in the corner portions or at the edges of the structure 1 the insulating plates 42*a* or 43*a* could be bevelled with an angle appropriate to the one which is formed by the structure 1 at the level of this edge in order to form joints as greatest possible. In addition the plates 42*a*, 43*a* are prefabricated with standard dimensions which could of course be modified by cutting in accordance with the shape of the structure to be provided.

The insulating plates 42*a*, 43*a* are disposed end to end so as to define in each layer 42, 43 generally linear joints 62, 63, respectively. These joints 62, 63 generally extend along a plane with a direction perpendicular to the middle plane of the panels 52, 53 over at least the whole thickness of the corresponding insulation layer 42, 43. Each one of the joints 63 formed in the external layer is covered by a strip 70 which is interposed and stuck between both layers of insulating foam 42 and 43 and is caused to be plumb with one plate 42*a* of the internal layer 42.

Figure 5:
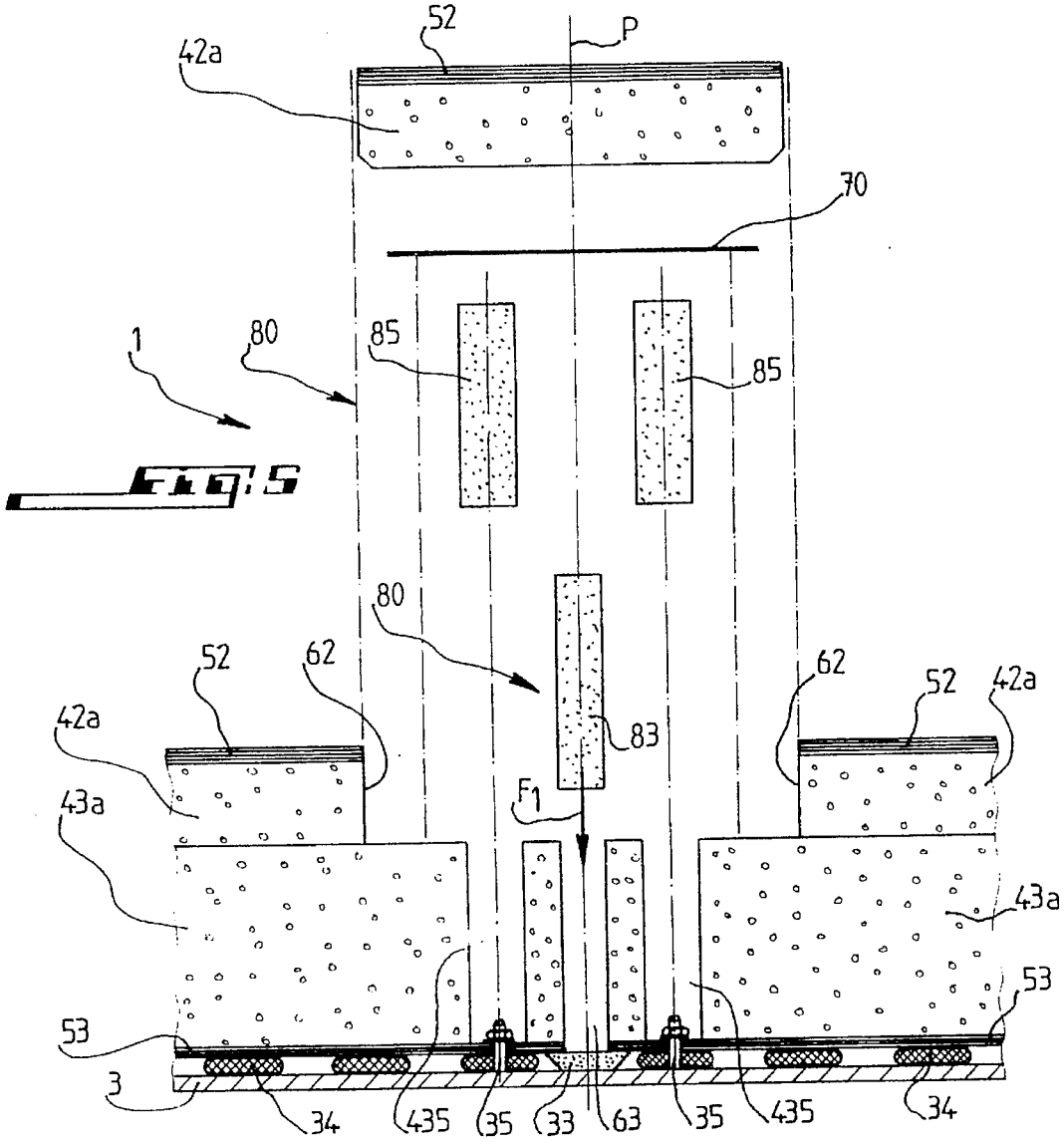
FIG. 5 is a view similar to FIG. 4 with stuck inserted fluid-tight connectors according to another embodiment of the invention.

According to the invention the distribution panels 53 are fastened to the external partition 3 in particular by screws or the like 35 visible on FIG. 5. These screws shown on the other figures by their longitudinal axes only are disposed in front of holes 435 themselves formed in the external insulation layer 43 at a distance from the joints 63 between the different juxtaposed plates 43*a* constituting this layer. Furthermore each one of the joints 63 and all the holes 435 involved are filled up by a connector 80 of thermally insulating and fluid-tight material. These insulating and fluid-tight connectors 80 could in particular be made from the same material or from a material similar to that of the insulation layer 42 and 43, for example of ethyl vinyl acetate. Moreover all the connectors 80 disposed within the joints 63 and in the holes 435 of the layer 43 are stuck to hermetically adhere to the walls of the hole 435 or of the corresponding joint 63 in order to make the external layer 43 continuous and fluid-tight over the whole surface defined by the structure 1.

One already understands that with such a structure 1 the secondary fluid-tightness is obtained by making the plates 43*a* and connectors 80 hermetically fast so that the prefabricated external insulation layer 43 forms after its assembly and its being stuck a continuous hence perfectly fluid-tight secondary barrier.

Moreover the joints 62 between the plates 42*a* of the internal insulation layer will preferably also be hermetically obturated by yielding (possibly stuck) seals of for example polymerized liquid sealing compound. In this case the secondary barrier is constituted by all the insulation system 4.

However since it is in particular the external insulation layer 43 which ensures a good confinement of the fluid inside of the structure 1 in case of cracking or the like for example in the primary barrier 2, it is not necessary that the strips 70 for covering the joints 63 and the connectors 80 be fluid-tight and hermetically fastened between both insulating layers 42 and 43. Therefore these cover strips 70 will have the main function of maintaining assembled the plates 42*a* and 43*a* of the corresponding insulation layers of the system 4. For that purpose it will be advantageous to use a reinforcing sheet such as a glass fiber fabric or the like which one will stick at least at the level of the joints 63 and of the holes 435 between the two corresponding insulation layers 42 and 43. With one of its faces adhering to at least two insulation plates 42*a* and its other face adhering to at least two plates 43*a*, each cover strip 70 will effectively reinforce the cohesion between the joint connectors 80 and the insulation plates 42*a*, 43*a*.

In order to obtain the best possible reinforcement, each cover strip 70 should largely extend beyond the surface of the external layer 43 where are formed the holes 435 and the joint 63 to be covered.

One sees on FIG. 1 that the prefabricated insulation plates 42*a* and 43*a* are disposed within the structure 1 in an offset manner in order that the joints 63 and the holes 435 of two external plates 43*a* be plumb with an internal plate 42*a*. With such an arrangement one will select the surface of each reinforcing strip 70 in order that it be substantially equal to that of the corresponding external plate 42*a*.

It is interesting when the requirements of assembly of the prefabricated elements of the structure 1 permit to entirely cover the external insulation layer 43 with a reinforcing fabric onto which could be stuck the reinforcing strips 70.

One will also remark here that by providing for disposing the holes 435 at a distance of the joints 63, the latter open in front of a solid surface of the corresponding distribution panels 53 so that it is easier to obtain a fluid-tightness between the layer 43 and the corresponding panel 53 in particular owing to the sticking of these two prefabricated elements.

Referring now to FIG. 5 which shows a first embodiment of the invention, one sees that the connectors 80 provided to fill up the holes 435 as well as the illustrated joints 63 are constituted by inserted parts with a shape corresponding to that of the openings (63, 435) to be filled up within the layer 43. More precisely the connector provided to be accommodated according to the direction of the arrow F1 within the joint 63 and designated at 83 is a flat-fluid-tight seal. This flat seal-shaped connector 83 has a length in the direction of the arrow F1 which is substantially equal to the thickness of the assembly constituted by the layer 43 and the panels 53.

On the other hand one sees that a pad 33 preferably made from a fluid-tight yielding plastic foam is interposed between the panels 53 arranged on either side of the joint 63 and the external partition 3. This pad 33 the section of which along a transverse plane perpendicular to the middle plane P of the joint 63 is trapezoidal, rests with one of its parallel faces the surface of which is the smallest upon the internal side of the partition 3. Moreover the longitudinal edges of its greatest parallel face are respectively bearing upon the external face in front of the partition 3 of one of the panels 53 contiguous to the joint 63. Owing to the tightening of the screws 35 for the fastening of the panels 53 onto the external partition 3, the longitudinal edges of the pad 33 are clamped between these panels 53 and the partition 3 after the manner of the bearing pads 34 visible on FIGS. 1 and 4. This clamping of the pads 33 permits to obtain a fluid-tight contact between the latter and panels 53. The fluid-tightness of this contact could be further improved by applying a hermetic adhesive between the lateral edges of each pad 33 and the corresponding panels 53. These pads 34 are glued on the one hand to the external wall 33 and on the other hand to one of the panels 53.

Figure 4:
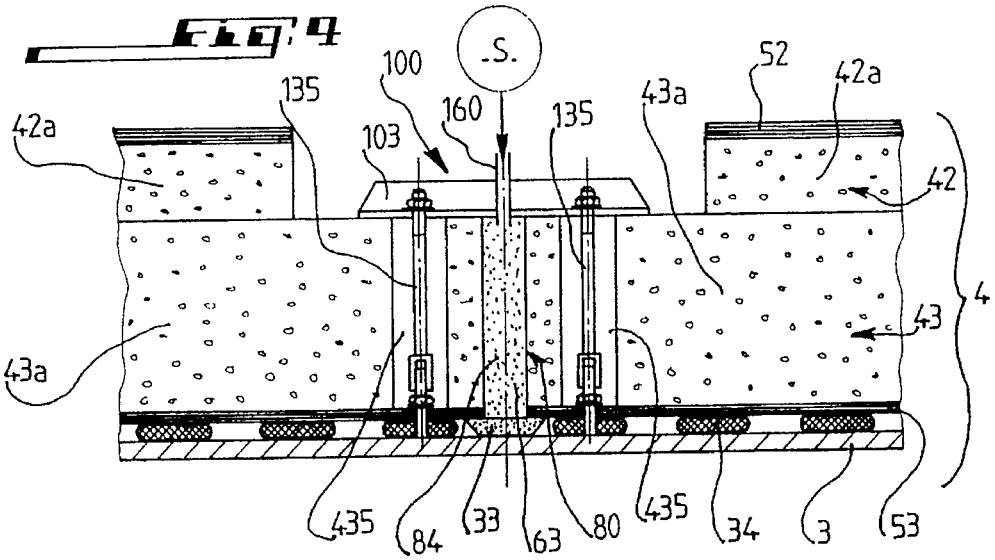
FIG. 4 is a partial view in cross-section of a joint in the insulation system of a structure with an injected fluid-tight connector according to an embodiment of the invention.

Although this is not visible on FIGS. 1 and 4 in particular, the external or peripheral faces of each connector 80 are coated with a suitable layer of adhesive, preferably a foaming adhesive. Thus when the connector 80 is inserted into the corresponding opening (63) or (435), the latter adheres in a hermetic fashion to the insulation plates 43*a* of the external layer and to the pad 33 in order to form one single continuous piece without any possible passage for the fluid to be stored within the structure 1.

To facilitate the making as well as the mounting of the connector 83 (or of any other connector 80 constituted by an inserted part), it is possible that the latter be obtained by the assembly of at least two elements stuck to each other. Preferably each element will be symmetrical to the other one along a plane coinciding with the middle plane or one of the middle planes of the opening 63 or 435 to be filled up with the assistance of that connector made from several elements. For example the connector 83 could be formed by the assembly of two elements symmetrical with respect to the middle plane P. The faces of these elements constituting the connector 83 which extend along the plane P are coated with a suitable preferably foaming adhesive and assembled just before the mounting and sticking of the connector thus constituted into the joint 63.

When looking at FIG. 1 one remarks that near a corner defined by two walls of the structure 1 one provides between the connector 80 which is here constituted by an inserted piece and the external partition 3 a stop for the positioning of the insulation plates 43*a* of the external layer 43. For that purpose instead of the pad 33 described hereabove one disposes on the side opposite to the plate 43*a* defining the said corner a bar 33' enclosed and stuck between the panel 53 corresponding to the other plate 43*a* and the external partition 3. In addition one places in bearing relation to this bar 33' a series of blocks 36 resting upon the end faces of one pad 34 of the panel 53 and of the plate 43 located towards the corner formed by the structure 1. These blocks will generally comprise from the right to the left on FIG. 1 for example a metallic piece, a connector of sealing compound and a block of plywood or laminated wood. The base of the corresponding connector 80 is of course stuck in a fluid-tight fashion onto this set of blocks 36. It is thus possible to make immovable the prefabricated elements involved in a suitable position in the direction perpendicular to the edge of the corner formed by the structure 1 at this place.

One also remarks on FIG. 1 that a void space 56 is provided in the joint 63 between the insulation layer 43 and the metal block 36 located on the side opposite to the corner defined by the structure 1. A filling up 86 for example of a sealing compound the elongated shape of which corresponds to that of the space 56 is provided within this space in order that the connector 80 may be caused to adhere over its whole base and to obturate in a fluid-tight manner the bottom of the joint 63 between the insulation plates 43*a*.

Similarly to what has just been explained, connectors 85 shown on FIG. 5 and provided to fill up the holes 435 are in the shape of cylindrical plugs or logs of a shape corresponding to that of each hole. Their end faces caused to be in front of the corresponding panel 53 are recessed in their center so that the screw 35 projecting into this hole 435 may be accommodated therein. However near the periphery of the plug forming the connector 85 one provides an annular end face which may be put in contact with the panel 53 constituting the bottom of the hole 435 and be hermetically stuck to the panel around the screw 35. Likewise the cylindrical walls of the connector 85 are coated with a suitable preferably foaming adhesive in order that the latter forms after the setting of the adhesive one single fluid-tight piece with the insulation plate 43*a* inside of which it is caused to be housed.

Furthermore quite like the seal forming the connector 83, the inserted cylindrical piece 85 could also be obtained by the assembly and sticking of two elements for example of polyurethane foam with closed cells.

On FIG. 4 the connector filling up the joint 63 between both juxtaposed insulation plates 43*a* is obtained in situ. More especially the bottom of the joint 63 is hermetically obturated by a pad 33 generally identical with the one which has been described above. An injection tool 100 is fastened onto the insulation system 4 in order to obturate the opening portion of the joint 63. The injection tool 100 is composed of a plate 103 adapted to be caused to hermetically bear upon the top face of the insulation layer 43 while covering the joint 63 and of at least two extension studs 135 provided for being fastened onto the screws 35. Thus the plate 103 of the tool 100 may be pressed in a fluid-tight manner upon the external insulation layer 43 so that the inside space defined by the joint 63 is hermetically closed. In addition the plate 103 of the tool 100 comprises an injection mouth 160 associated with at least one vent which allows to put the inside of the joint 63 in communication with a source S of insulating and fluid-tight plastic material which may expand itself, such preferably as polyurethane with closed cells.

Once the tool 100 and the source S are positioned as illustrated on FIG. 4, the plastic material from the source S is injected under a suitable pressure into the space defined by the joint 63 so as to fill up the latter completely. When the injected expansible material here designated at 84 is dried and when it hermetically adheres to the walls of the joint 63 and of the pad 33 one has obtained a connector 80. Once the tool 100 has been removed, the material 84 of the connector 80 and both-plates of insulating material 43*a* juxtaposed to the corresponding connector 63 form but one single continuous piece and therefore may in no case let a fluid pass. One should note here that although this has not been illustrated the holes 435 provided for the access to the assembly or fastening screws 35 may also be filled up through injection of an expansible fluid-tight material such as that designated at 84.

Of course owing to an injection tool such as the one which has just been described, the material 80 could fill up the joint 63 until being flush with the external insulation layer 43 in such a manner that the plates 43*a* will be connected in a continuous fashion by the connector 80 thus made and that it will be easy to apply a reinforcing strip 70 onto a surface thus formed. One should specify here that the pressure for the injection of the material 84 as well as the force necessary to accommodate the connectors 80 constituted by inserted pieces such as those which are illustrated on FIG. 5 will be chosen in order that in the final position of these connectors 80 and of the juxtaposed plates 43*a*, the stresses generated by these connectors 80 inside of the external layer 43 have a negligible value in particular with respect to the force of cohesion exerted upon the adhesives (inclusive by the injected material 84) as well as the cover strips 70 which connect the connectors 80 and the plates 43*a*.

Figures 2, 3:
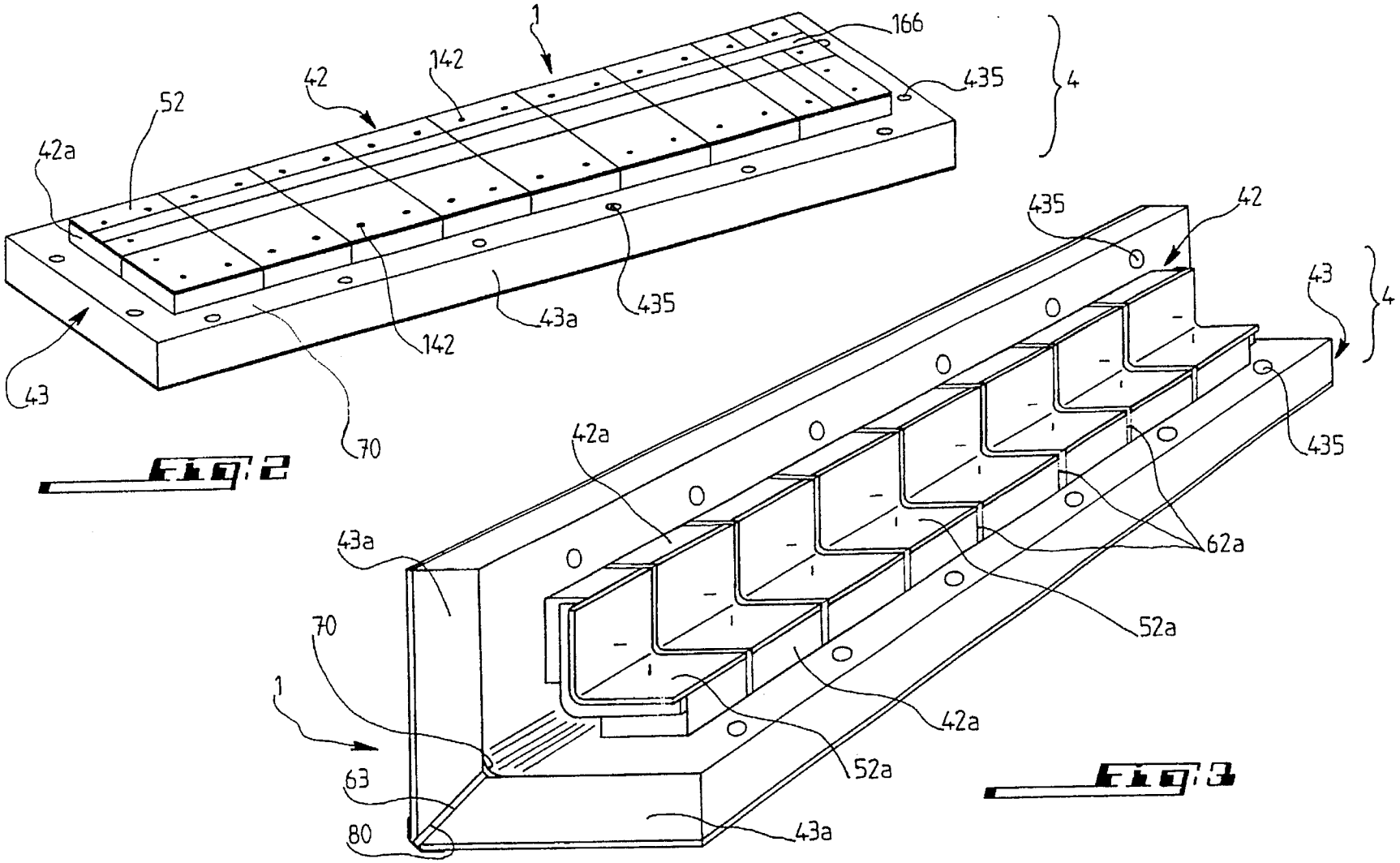
FIG. 2 is a diagrammatic perspective view of a flat prefabricated panel for a structure according to the invention.
FIG. 3 is a diagrammatic perspective view of a prefabricated corner panel for a structure according to the invention.

According to the FIGS. 1 and 3, one remarks that in the corners at 90° or with a different angle, the panel 52 for the distribution of the forces is replaced by a metallic angle member. As one sees it better on FIG. 3, the metallic angle member is constituted by elements 52*a* of stainless metal such as treated steel or aluminum which are juxtaposed and assembled with the assistance of screws 45 (FIG. 1) caused to be fastened into the material of the plates 42*a* constituting the internal insulation layer 42 of the system 4. A yielding seal 62*a* such as the one which is described when referring to FIG. 1 may be interposed between the elements 42*a* so as to adhere to the latter.

Here too when the bevelled plates 43*a* will be assembled with the assistance of the angle member 80 such as the one of FIG. 3, the whole layer 43 will be covered with a strip 70 preferably of glass fiber. Then the insulation plates 42*a* forming through juxtaposition the internal layer 42 will be assembled with at the level of the corner defined by the structure 1, an angle connector 82 (FIG. 1) hermetically stuck to the plates 42*a* which are contiguous thereto.

Similar to the prefabricated structure 1 of FIG. 3 which forms a corner wall one has shown on FIG. 2 a flat structure 1 consisting of prefabricated elements assembled according to the invention.

in the prefabricated structure of FIG. 2 the panel 52 consists of elements fastened to the corresponding insulation plates 42*a* by sticking. One could provide onto such a panel 52 metallic inserts 142 for the fastening of tools in particular. Strips of stainless metal 166 which extend transversely of each one of the elements of the panel 52 are respectively set into suitable recesses disposed in alignment and formed within the elements which constitute this panel through juxtaposition.

As one has shown it diagrammatically on FIG. 2, it will also be possible with the prefabricated element visible on this figure to interpose between the layer 43 and the layer 42 a glass fibre fabric 70 which extends beyond the holes 435 of this prefabricated element. Such sheets could be stuck to each other by the cover strips so as to form but one single reinforcing envelope over the whole surface of the structure 1.

One has therefore obtained according to the invention a structure 1 which in case of a leakage through the primary barrier 2 permits to manage that the thermal gradient in the insulation system 4 not be affected.

It is also appropriate to specify here that since the layer 70 no longer has a mechanical function it is no longer necessary to provide a fluid-tight metal sheet held like a sandwich at the level of the strips and of the cover sheet. In fact in addition to the decrease in costs connected to the obtaining of the structure from prefabricated elements the invention allows to reduce in a substantial manner the manufacturing costs of the tanks for the cryogenic liquids in, for example, merchant ships while warranting a quality of insulation and fluid-tightness greater than that one could obtain from the prior art. In particular the displacement of the secondary fluid-tightness permits to use a less expensive steel grade for the external support partition.

The invention is of course not at all limited to the embodiments which have just been described but comprises all the equivalents and the combination of the technical means explained and illustrated if the latter are carried out according to its gist.

Thus between two insulation plates of the external layer one could provide that some fluid-tight connectors be obtained through injection and others through sticking of inserted parts.

What is claimed is:

1. In a prefabricated structure for forming fluid-tight and thermally insulating walls of a container for a very low temperature fluid, comprising, a substantially flexible fluid-tight internal primary barrier having an inner face in contact with said fluid and an outer face;

an internal distribution panel layer secured to said outer face of said primary barrier;

a rigid external partition having an outer face and an inner face;

an external distribution panel layer secured to said inner face of said external partition;

two intermediate thermal insulation panel layers, said layers held in sandwich-like fashion between said internal and external distribution panel layers and comprising an external and an internal layer, each of said thermal insulation layers being constituted by jutaposed insulating plates made from a fluid-tight material;

wherein each of said insulating plates of each thermal insulating panel layer forms a joint with an adjacent insulating plate of that thermal insulating panel layer, said plates being located in a way that the joints in one layer are situated in front of a plate of the other layer; and a cover strip situated between and adhering to said two insulation layers in a way to cover each said joint, and a connector made from a fluid-tight insulating material being provided for obturating each said joint;

said external insulation layer containing a plurality of holes at a predetermined distance from said joints in said external insulation layer and said external distribution panel being fastened to said external partition by fastening members located at an outer end of said holes formed in said external insulation layer; and fluid-tight connectors made from insulating material provided for filling up and hermetically adhering to a respective one of said holes whereby said external insulating layer is continuous and fluid-tight over its entire surface.

2. Structure according to claim 1, wherein a pad of fluid-tight material onto which hermetically adheres the connector of a joint is interposed between said external distribution panel and said external partition.

3. Structure according to claim 1, wherein a yielding seal is interposed between the plates of insulating material which constitute the internal insulation layer and adheres to the internal insulation layer.

4. Structure according to claim 1, wherein a metallic angle member forming a distribution panel is interposed between the primary barrier and the internal insulation layer and is fastened to the internal insulation layer.

5. Structure according to claim 1, wherein each said cover strip is constituted by a continuous reinforcing sheet of glass fibers, which extends over a surface zone of the external layer plate including said joint and said holes.

6. Structure according to claim l, wherein said connectors are formed in situ through injection under pressure from fluid-tight plastic insulation material.

7. Structure according to claim 1, wherein said fluid-tight material is plastic foam with closed cells.

8. Structure according to claim 1, wherein said fastening members are screws.

9. Structure according to claim 1, wherein at least one of the connectors has an external peripheral surface coated with an adhesive foaming material.

10. Structure according to claim 9, wherein at least two of the connectors are arranged substantially symmetrical with respect to a middle plane (P) of assembly.

11. Structure according to claim 9, wherein the said adhesive material is a foaming material.

* * * * *